US006152556A

United States Patent [19]

Sherman et al.

[11] Patent Number: 6,152,556

[45] Date of Patent: Nov. 28, 2000

[54] DROPLET GENERATOR FOR A CONTINUOUS STREAM INK JET PRINT HEAD

[75] Inventors: Nigel Edward Sherman, Rougham; Graham Dagnall Martin, Sawston; Sukbir Singh Pannu, Grantchester, all of United Kingdom

[73] Assignee: Marconi Data Systems Inc., Wood Dale, Ill.

[21] Appl. No.: 08/930,784

[22] PCT Filed: Mar. 19, 1996

[86] PCT No.: PCT/GB96/00634

§ 371 Date: Nov. 28, 1997

§ 102(e) Date: Nov. 28, 1997

[87] PCT Pub. No.: WO96/31351

PCT Pub. Date: Oct. 10, 1996

[30] Foreign Application Priority Data

Apr. 4, 1995 [GB] United Kingdom ..... 9506980

[51] Int. Cl.[7] ..... B41J 2/02

[52] U.S. Cl. ..... 347/75; 347/48; 347/68

[58] Field of Search ..... 347/75, 74, 48, 347/68

[56] References Cited

U.S. PATENT DOCUMENTS

| | | | |
|---|---|---|---|
| 3,739,393 | 6/1973 | Lyon et al. | 347/75 |
| 4,104,645 | 8/1978 | Fischbeck | 347/48 |
| 4,291,316 | 9/1981 | Kakeno et al. | 347/48 |
| 4,746,929 | 5/1988 | Lin et al. | 347/75 |
| 5,229,793 | 7/1993 | Hadimioglu et al. | 347/46 |
| 5,305,016 | 4/1994 | Quate | 347/46 |

FOREIGN PATENT DOCUMENTS

| | | | |
|---|---|---|---|
| 0 621 135 | 10/1994 | European Pat. Off. | 347/12 |
| 355067476 | 5/1980 | Japan | 347/48 |
| 83/00657 | 3/1983 | WIPO | B41J 3/04 |

OTHER PUBLICATIONS

Electronics and communications in Japan, Part:II, vol. 72, No. 7, Scripta Technica, Inc., pp. 78–86, Jul. 1989.

*Primary Examiner*—N. Le
*Assistant Examiner*—Shih-Wen Hsieh
*Attorney, Agent, or Firm*—Piper Marbury Rudnick & Wolfe

[57] ABSTRACT

A droplet generator for a continuous stream ink jet print head has a cavity (3, 23) for containing the ink; nozzle orifices (17, 27) in a wall (9) of the cavity (3, 23) for passing the ink from the cavity (3, 23) to form jets; and first (11, 21) and a second (13, 25) actuator device for establishing in combined operation a travelling wave. The travelling wave travels from the fist actuator device (11, 21) through the ink to the second actuator device (13, 25) and passes in a direction substantially parallel to the wall (9) containing the nozzle orifices (17, 27).

15 Claims, 2 Drawing Sheets

1
3
5
7
9
11
13
15
17
II
III

DROPLET GENERATOR FOR A CONTINUOUS STREAM INK JET PRINT HEAD

This invention relates to a droplet generator for a continuous stream ink jet print head. U.S. Pat. No. 4,746,929 discloses a droplet generator for a continuous stream ink jet print head wherein a piezoelectric transducer located at one end of an ink filled tube causes waves to travel through the ink along the tube to an absorber at the other end of the tube. The purpose of the absorber is to suppress reflection at the other end of the tube and hence inhibit the formation of standing waves along the tube. A line of nozzle orifices in the tube runs the length of the tube parallel to the direction of travel of waves along the tube. Each orifice communicates with a respective orifice in a plate bonded to, and also running the length of, the tube. The orifices pass ink from the tube to form jets. Suppression of reflection at the end of the tube opposite the piezoelectric transducer is so that the amplitude of the wave travelling along the tube is the same at all points along the length of the tube. Reflection would cause interference with the wave coming from the transducer which would set up standing waves, and thus result in the amplitude not being as aforesaid. By having the amplitude the same at all points along the tube it is ensured that the jets emanating from the nozzle orifices of the tube break up into droplets at the same distance from the tube.

The absorber of the droplet generator of U.S. Pat. No. 4,746,929 must be chemically resistant to the ink, must have an impedance close to that of the ink in order to minimise reflection, and must have a high attenuation coefficient such that once acoustic energy has entered the absorber it does not re-emerge following reflection therewithin. Thus, the absorber is required to have properties which are ink type and frequency specific.

EP-A-449929 discloses a droplet generator for a continuous stream ink jet print head wherein a piezoelectric load rod at one side of an ink filled cavity establishes a standing wave within the cavity at resonance thereof. The nozzle orifices are located on the opposite side of the cavity to the load rod. As with the droplet generator of U.S. Pat. No. 4,746,929 the object is that the amplitude of vibration of the ink is the same across the nozzle orifices.

In EP-A-449929 to achieve resonance for a given ink type the dimension of the cavity from the load rod side to the nozzle orifice side must have a precise value. Thus, the droplet generator of EP-A-449929 is sensitive to structure and assembly, e.g. the tightness of the bolts which secure the cavity assembly together.

According to the present invention there is provided a droplet generator for a continuous stream ink jet print head comprising: a cavity for containing the ink; nozzle orifices in a wall of said cavity for passing the ink from the cavity to form jets; and first and second actuator means for establishing in combined operation a travelling wave which travels from said first actuator means through said ink to said second actuator means and passes in a direction substantially parallel to said wall containing the nozzle orifices.

The invention will now be described, by way of example, with reference to the accompanying schematic drawings, in which.

Figures 1, 2, 3:
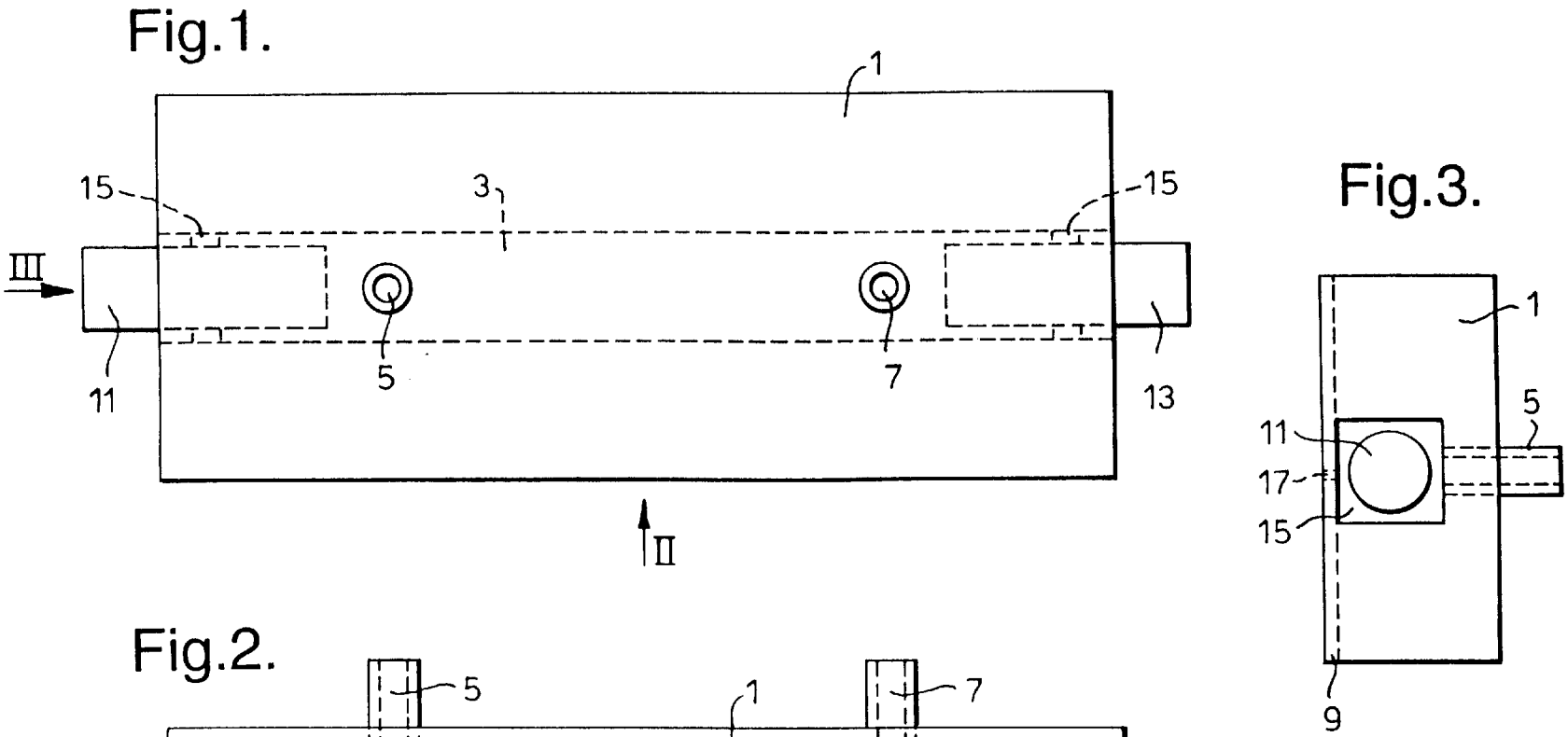
FIG. 1 is a plan view of a first droplet generator in accordance with the present invention.
FIG. 2 is a front view of the generator of FIG. 1.
FIG. 3 is a side view of the generator of FIG. 1.

Referring to FIGS. 1 to 3, a housing 1 contains an elongate square cross-section cavity 3 for containing the ink. Housing 1 includes an ink inlet connection 5, an ink bleed connection 7, and a plate 9 containing a line of nozzle orifices 17 for passing the ink from cavity 3 to form jets. Transmitting and receiving piezoelectric transducers 11, 13 are mounted, by means of nodal clamps 15, at either end of cavity 3.

In operation transmitting transducer 11 is excited to vibrate at a set frequency and amplitude to cause a travelling wave to pass along cavity 3 to receiving transducer 13. Initially transducer 13 is not driven but is used to sense the phase and amplitude of the travelling wave from transducer 11 impinging on transducer 13. Transducer 13 is then driven with the sensed phase and amplitude, with the consequence that it does not appear to the wave travelling from transducer 11 as a reflection boundary but simply a continuation of the path through the ink, i.e. transducer 13 mimics the compression/rarefaction of the ink immediately thereadjacent and therefore appears as the continuation of the ink path. By driving transducer 13 at the initially sensed amplitude. account is taken of amplitude attenuation along the length of cavity 3 and the reflection coefficient of the ink/transducer 13 interface. Another way to consider the function of transducer 13 is that it generates a wave of equal amplitude and opposite phase to the reflection of the incoming wave.

The purpose of preventing reflection at receiving transducer 13 is to preserve the travelling wave nature of the wave in cavity 3. If a travelling wave is present in cavity 3, the amplitude of ink vibration will be the same across all nozzle orifices 17 of plate 9, with the consequence that the break up into droplets of the jets emanating from orifices 17 will take place, as is desirable, at the same distance from plate 9. Reflection at receiving transducer 13 would result in the formation of standing waves in cavity 3, with the amplitude then not being the same across all nozzle orifices 17. With a travelling wave present in cavity 3 there will be a variation in the phase of ink vibration across nozzle orifices 17, such that the jets emanating therefrom break up at different times. This is accounted for in the ink jet print head air the timing of the signals supplied to the charge electrodes of the print head.

During initial set-up when transducer 13 is not driven, the transmitted and received signals are monitored using a digital storage oscilloscope. The voltage amplitude of the received signal and the phase of the received signal relative to the transmitted signal are measured manually using the digital cursor facilities of the oscilloscope. To then establish the desired travelling wave, transducer 13 is driven with an amplitude equal to the monitored voltage amplitude of the received signal and a phase equal to the inverse of the monitored phase of the received signal relative to the transmitted signal. The reason the inverse phase is used is to take account that a peak pressure in the travelling wave in cavity 3 impinging on transducer 13 corresponds to a trough in the voltage signal applied to piezoelectric transducer 13. Instead of using an oscilloscope to derive the relevant phase and amplitude parameters, a phase meter and peak detector electronics may be used.

Figure 4:
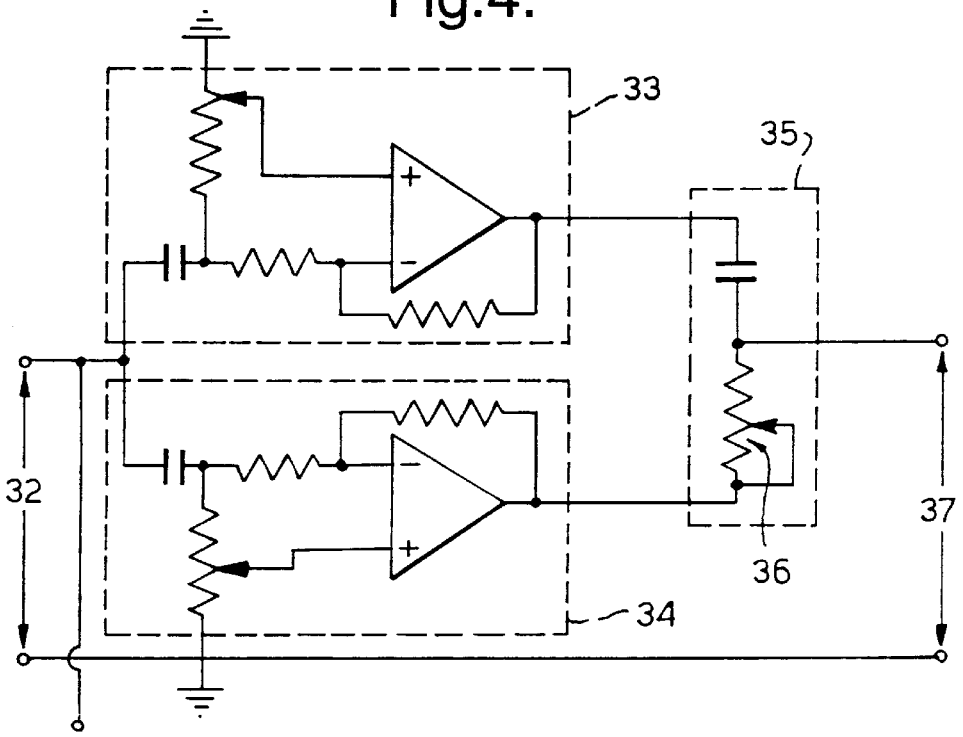
FIG. 4 illustrates a phase shifter circuit for use with the generator of FIG. 1.

The appropriate drives for transducers 11, 13 to establish the desired travelling wave are provided with the use of the phase shifter circuit of FIG. 4. A signal of a given amplitude and phase is supplied to input 32 of the shifter. The outputs of two unity gain amplifiers 33, 34, one inverting 33, the other not 34, are applied across RC network 35. By adjusting variable resistor 36 of network 35 a signal having a phase from 0° to +180° relative to the input at 32 may be obtained at output 37. To obtain 0° to −180° relative phase, the output at 37 may be fed to a further unity gain inverting amplifier (not shown). Thus, all phase shifts are available to achieve the aforementioned inverse of the oscilloscope monitored phase of the received signal relative to the transmitted signal. To achieve the aforementioned oscilloscope monitored voltage amplitude of the received signal, the output at 37 is passed to a variable gain amplifier (not shown). Thus, the drive for transmitting transducer 11 is obtained from input 32, and the drive for receiving transducer 13 from output 37, either via or not the aforementioned further unity gain inverting amplifier, and via the aforementioned variable gain amplifier.

The droplet generator of FIGS. 1 to 3 does not rely on the resonance of cavity 3. Thus, it is not a requirement for a given ink type that the long dimension of cavity 3 have a precise value. Different ink types may be accommodated without alteration to the length of cavity 3.

Since an active element, receiving transducer 13, is used to control reflection at the end of cavity 3 opposite transmitting transducer 11, an absorber is not required at this end which has an impedance close to that of the ink and a high attenuation coefficient. Further, since the head of transducer 13 in contact with the ink is suitably made of stainless steel, it is universally chemically ink resistant.

For a given ink there will be a given amplitude attenuation and phase variation along the length of cavity 3. The amplitude attenuation is catered for by setting receiving transducer 13 to vibrate at the amplitude of the wave impinging thereon. The phase variation is catered for by appropriately timing the signals supplied to the charge electrodes of the print head. Thus, it will be seen that different ink types may easily be accommodated. Similarly, variation in the material properties, e.g. viscosity, of a given ink may easily be accommodated.

In a modification to the aforedescribed operation of the droplet generator, transmitting transducer 11 is driven to transmit a travelling wave that consists of a component at a fundamental frequency and at least one component at a harmonic thereof, the harmonic component(s) being such as to inhibit the formation of unwanted so called satellite droplets in the break up of the jets. IBM Technical Disclosure Bulletin, Vol. 21, No. 8, January 1979, page 3332, contains an article entitled 'Elimination of Satellites in the Synchronous Breakup of a Liquid Jet' by K. C. Chaudhary which describes the use of harmonic component(s) to inhibit satellite formation in jet break up. Receiving transducer 13 is again driven so that it does not reflect the wave transmitted by transmitting transducer 11.

The droplet generator of the drawing may be modified by replacing transducers 11, 13 at either end of elongate cavity 3 by a transmitting transducer which runs along the length of the back side of cavity 3 and a receiving transducer which runs along the front side of cavity 3. Operation would be as before, but, since the line of nozzle orifices 17 is now perpendicular to the direction of passage of the travelling wave, the phase as well as the amplitude will be the same across nozzle orifices 17.

Figure 5:
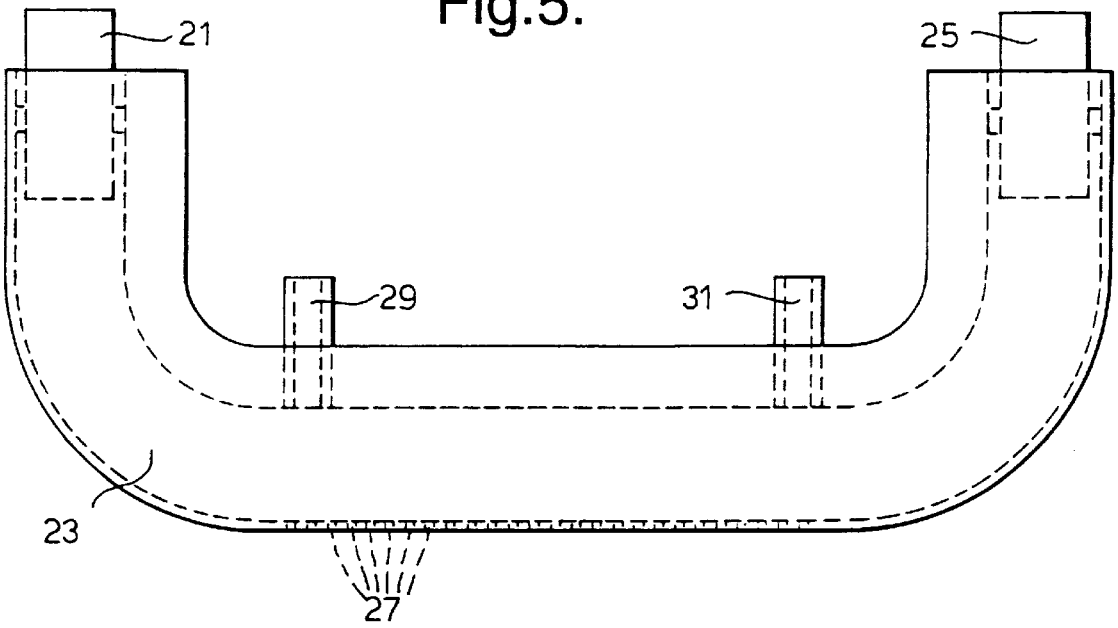
FIG. 5 illustrates a second droplet generator in accordance with the present invention.

Referring to FIG. 5, in the second droplet generator a travelling wave generated by a transmitting transducer 21 at one end of a shallow U-shaped ink cavity 23 is guided by the cavity therealong to a receiving transducer 25 at the other end thereof. Thus, the travelling wave experiences two 90 degree turns. A line of nozzle orifices 27 extends along the bottom flat side of cavity 23. Inlet and bleed connections 29, 31 are present in the top flat side of cavity 23. As with the droplet generator of FIGS. 1 to 3, transducers 21, 25 may be driven either to establish a travelling wave of a single frequency which is the frequency of excitation of transmitting transducer 21, or a travelling wave consisting of a component at the fundamental frequency of transducer 21 and at least one component at a harmonic thereof.

It is to be appreciated that although in the above description of the first droplet generator the ink containing cavity is of square cross-section, this need not be so. In particular, a circular cross-section could be used.

What is claimed is:

1. A droplet generator for a continuous stream ink jet print head comprising: a cavity (3, 23) for containing the ink; nozzle orifices (17, 27) in a wall (9) of said cavity (3, 23) for passing the ink from the cavity (3, 23) to form jets; and first (11, 21) and second (13, 25) actuator means each vibrating so as to establish in combined operation a traveling wave which travels from said first actuator means (11, 21) through said ink to said second actuator means (13, 25) and passes in a direction substantially parallel to said wall (9) containing the nozzle orifices (17, 27).

2. A generator according to claim 1 wherein said first actuator means (11, 21) is driven at a single frequency, and said combined operation is such that said travelling wave is of this single frequency.

3. A generator according to claim 2 wherein: said cavity (3) is elongate; said nozzle orifices (17) run in a line along the length of said cavity (3); and said first (11) and second (13) actuator means are disposed so as to oppose one another across said cavity (3) in the direction of the length of said cavity (3) such that said travelling wave travels in a direction substantially parallel to said line of nozzle orifices (17).

4. A generator according to claim 2 wherein: said cavity (3) is elongate; said nozzle orifices (17) run in a line along the length of said cavity (3); and said first and second actuator means are disposed so as to oppose one another across said cavity (3) in the direction of the width of said cavity (3) such that said travelling wave travels in a direction substantially perpendicular to said line of nozzle orifices (17).

5. A generator according to claim 2 wherein: said cavity (23) is elongate and turns through 90 degrees at each end; said nozzle orifices (27) run in a line along the length of a straight section of said cavity (23) between the 90 degree turns; and said first (21) and second (25) actuator means are disposed one at each end of said cavity (23) in its passage from said first (21) to said second (25) actuator means said travelling wave being guided by said cavity (23) both around the two 90 degree turns and along the straight section therebetween so that the wave travels in a direction substantially parallel to said line of nozzle orifices (27).

6. A generator according to claim 1 wherein said first actuator means (11, 21) is driven such that its actuation consists of a component at a fundamental frequency, and at least one component at a harmonic thereof and said combined operation is such that said travelling wave consists of said component at said fundamental frequency and said at least one component at a harmonic thereof.

7. A generator according to claim 6 wherein: said cavity (3) is elongate; said nozzle orifices (17) run in a line along the length of said cavity (3); and said first (11) and second (13) actuator means are disposed so as to oppose one another across said cavity (3) in the direction of the length of said cavity (3) such that said travelling wave travels in a direction substantially parallel to said line of nozzle orifices (17).

8. A generator according to claim 6 wherein: said cavity (3) is elongate; said nozzle orifices (17) run in a line along the length of said cavity (3); and said first and second actuator means are disposed so as to oppose one another across said cavity (3) in the direction of the width of said cavity (3) such that said travelling wave travels in a direction substantially perpendicular to said line of nozzle orifices (17).

9. A generator according to claim 6 wherein: said cavity (23) is elongate and turns through 90 degrees at each end; said nozzle orifices (27) run in a line along the length of a straight section of said cavity (23) between the 90 degree turns; and said first (21) and second (25) actuator means are disposed one at each end of said cavity (23) in its passage from said first (21) to said second (25) actuator means said travelling wave being guided by said cavity (23) both around the two 90 degree turns and along the straight section therebetween so that the wave travels in a direction substantially parallel to said line of nozzle orifices (27).

10. A generator according to claim 1 wherein: said cavity (3) is elongate; said nozzle orifices (17) run in a line along the length of said cavity (3); and said first (11) and second (13) actuator means are disposed so as to oppose one another across said cavity (3) in the direction of the length of said cavity (3) such that said travelling wave travels in a direction substantially parallel to said line of nozzle orifices (17).

11. A generator according to claim 1 wherein: said cavity (3) is elongate; said nozzle orifices (17) run in a line along the length of said cavity (3); and said first and second actuator means are disposed so as to oppose one another across said cavity (3) in the direction of the width of said cavity (3) such that said travelling wave travels in a direction substantially perpendicular to said line of nozzle orifices (17).

12. A generator according to claim 1 wherein: said cavity (23) is elongate and turns through 90 degrees at each end; said nozzle orifices (27) run in a line along the length of a straight section of said cavity (23) between the 90 degree turns; and said first (21) and second (25) actuator means are disposed one at each end of said cavity (23) in its passage from said first (21) to said second (25) actuator means said travelling wave being guided by said cavity (23) both around the two 90 degree turns and along the straight section therebetween so that the wave travels in a direction substantially parallel to said line of nozzle orifices (27).

13. The generator according to claim 1, wherein said second actuator further is actively driven for forming and emitting a canceling wave for creating the appearance of continuation of the path of said traveling wave and for eliminating a reflection boundary.

14. The generator according to claim 13, wherein said canceling wave has an equal amplitude and opposite phase of said traveling wave.

15. The generator according to claim 13, wherein said second transducer mimics the compression or rarefaction or both of the ink adjacent said second transducer.

* * * * *